United States Patent [19]

Binder

[11] Patent Number: 4,799,595

[45] Date of Patent: Jan. 24, 1989

[54] APPARATUS FOR THE CLASSIFYING OF POWDERED BULK MATERIALS

[75] Inventor: Ulrich Binder, Ennigerloh, Fed. Rep. of Germany

[73] Assignee: O&K Orenstein & Koppel Aktiengesellschaft, Dortmund, Fed. Rep. of Germany

[21] Appl. No.: 944,342

[22] Filed: Dec. 19, 1986

[30] Foreign Application Priority Data

Dec. 21, 1985 [DE] Fed. Rep. of Germany ..... 3545691

[51] Int. Cl.[4] ..... B07B 4/00

[52] U.S. Cl. ..... 209/135; 209/144; 209/154

[58] Field of Search ..... 209/133, 144, 148, 154, 209/134, 135, 145, 143; 55/261

[56] References Cited

U.S. PATENT DOCUMENTS

| | | | |
|---|---|---|---|
| 2,222,396 | 11/1940 | Bowen | 209/144 |
| 3,199,272 | 8/1965 | Oehlrich | 55/261 |
| 3,372,805 | 3/1968 | Lykken et al. | 209/144 |
| 3,477,569 | 11/1969 | Klein et al. | 55/261 |
| 4,296,864 | 10/1981 | Misaka et al. | 209/144 |
| 4,551,241 | 11/1985 | Saverse et al. | 209/144 |
| 4,602,924 | 7/1986 | Eschenburg | 209/144 |
| 4,661,244 | 4/1987 | Hanke et al. | 209/144 |

FOREIGN PATENT DOCUMENTS

| | | | |
|---|---|---|---|
| 323117 | 1/1914 | Fed. Rep. of Germany . | |
| 2053323 | 8/1972 | Fed. Rep. of Germany . | |
| 2220535 | 8/1973 | Fed. Rep. of Germany | 209/144 |
| 2536382 | 6/1977 | Fed. Rep. of Germany . | |
| 3521638 | 12/1986 | Fed. Rep. of Germany . | |
| 2176426 | 12/1986 | United Kingdom | 209/148 |

OTHER PUBLICATIONS

"Zyklon Umluftsichter" Prospectus No. 3-440d, Humboldt Wedag, Dec. 1979.

*Primary Examiner*—Robert B. Reeves
*Assistant Examiner*—Donald T. Hajec
*Attorney, Agent, or Firm*—Martin A. Farber

[57] ABSTRACT

The invention relates to an apparatus for classifying powdered bulk materials, particularly ground clinker, limestone or cement raw material, by air sifting. The material to be classified is fed to the cover plate of a cylindrical rotor and charged into a sifting space having the shape of a cylindrical ring which extends between the rotor and a stationary vane ring which is spaced from and surrounds the rotor. While the coarse material descends in the sifting space, the fine material is conveyed into the inside of the rotor and fed to a subsequent separating device for the separating of fine material and sifting air. In order to simplify the construction and stocking, both the rotor and the housing surrounding it are assembled in building-block fashion from a plurality of identical sections, at least one tangential air inlet connection being associated with each housing section. Each housing section can have associated with it at least one cyclone of its own with its own fan. The rotor shaft can also be assembled from individual sections.

4 Claims, 4 Drawing Sheets

FIG.6
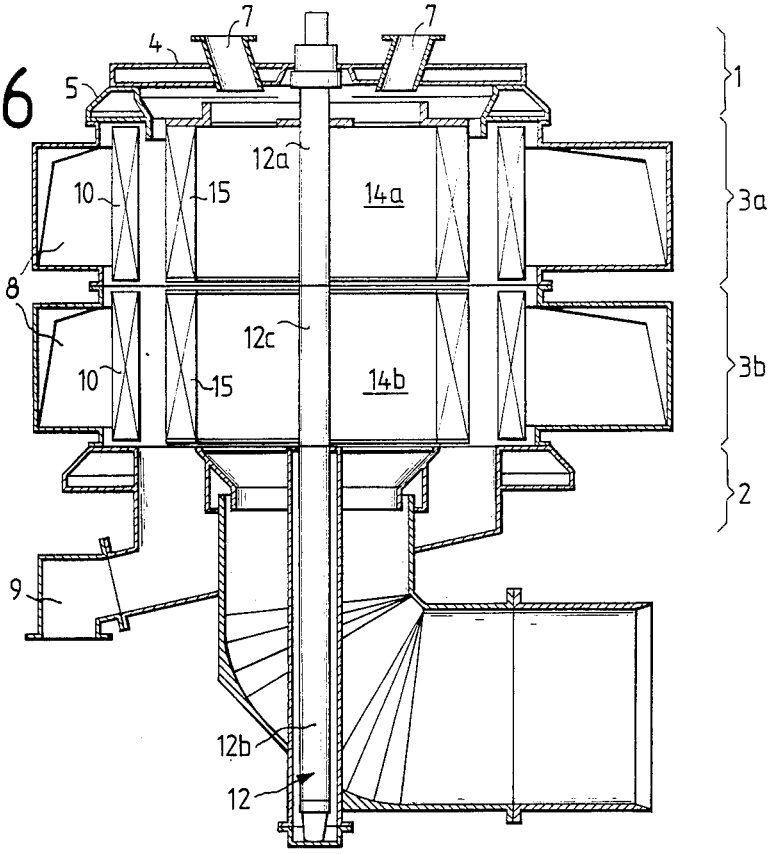
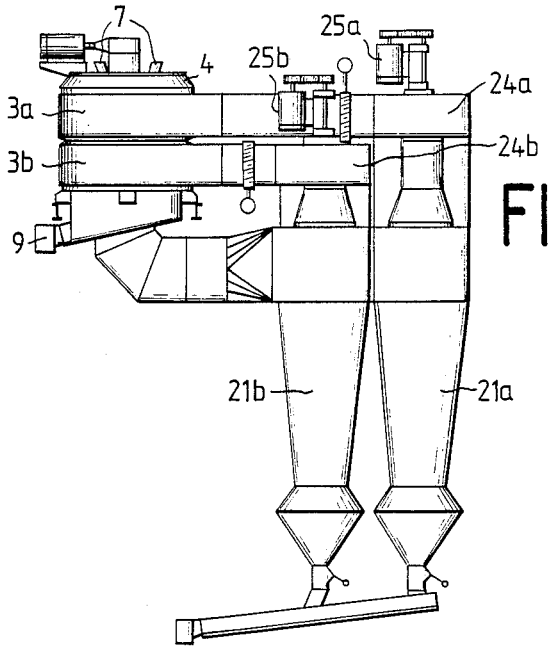
FIG.7

APPARATUS FOR THE CLASSIFYING OF POWDERED BULK MATERIALS

FIELD AND BACKGROUND OF THE INVENTION

The present invention relates to an apparatus for classifying powdered bulk materials, particularly ground clinker, limestone or cement raw material, by air sifting, the material to be classified being fed via a material inlet in the cover plate of a cylindrical rotor with vertically extending rotor blades and charged into a sifting space having the shape of a cylindrical ring which extends between the rotor and a stationary vane ring surrounding and spaced from the rotor, through which ring sifting air is drawn-in approximately tangentially by a fan located on the outside so that the fine material contained in the material which is charged is conveyed into the inside of the rotor as a result of the suction action which results from the difference between the conveying action of the fan and the radially outward-directed conveying action of the rotor, conducted vertically downward through a pipe and fed to a subsequent separating device for the separating of fine material and sifting air, while the coarse material drops down in the sifting space and is discharged via a coarse-material discharge which is passed through by the fine-material/sifting air discharge pipe.

Apparatus of the above-described type for the classifying of powdered bulk materials by sifting air are well known. They have the advantage, it is true, of good sharpness of separation as a result of the sifting space of annular cylindrical shape, but in order to control different rates of flow of bulk material a plurality of such sifters of different size are required.

The object of the present invention is to improve the aforementioned known apparatus for purpose of equalization of the air distribution over the circumference of the apparatus by simplification of its construction so as, instead of a plurality of, as a whole—particularly in diameter—different structural sizes in order to cover the different rates of flow, to be able to use a single structural form with constant base parts of the same diameter.

SUMMARY OF THE INVENTION

The solution of this object by the invention is characterized by the fact that both the rotor and the cylindrical housing part receiving the vane ring, together with the vane ring, is assembled in building-block fashion from a plurality of identical axial sections, each housing section having at least one tangential air inlet connection associated with it and to arrange the guide vanes of the vane rings of each housing section vertical, direct them at the same acute angle to the tangent and develop them with a width which increases in the direction of flow.

In this way there is obtained a cross section of flow for the feeding of the sifting air which decreases helically in the direction of flow, and thus a uniform distribution of the air over the circumference of each section of the vane ring.

On basis of this development in accordance with the invention, it is possible to adapt the classifying device for powdered bulk material, with the use of identical individual parts, to the output necessary in each case by varying the axial length of rotor and housing part with vane ring by the use of a corresponding number of identical rotor or vane-ring sections.

In a preferred embodiment of the invention, the air-inlet connections of housing sections arranged one above the other are arranged staggered with respect to each other in circumferential direction in a manner corresponding to the number of sections, whereby the feed of air is made uniform.

In accordance with another feature of the invention at least one cyclone, on which there is placed a fan of its own, is placed on each housing section. In this way, with an increase of the output of the apparatus of the invention by the use of one or more additional axial sections both for the rotor and for the housing the required increase in the fan outputs is automatically obtained since in each case at least one additional cyclone with corresponding fan is associated with the additional housing sections. Accordingly, for the cyclones and fans there is also used a single structural form which, due to multiple use, provides for the desired output in each case. By this further development in accordance with the invention there are furthermore obtained the advantages that pipelines and pipe elbows are saved and in this way less pressure loss results due to smaller and shorter air lines. Finally, this development creates the possibility, as compared with the use of a single fan, that the amount of air for each axial section can be selected freely and independently of other axial sections, as a result of which the sifting process can be favorably influenced.

It is finally proposed with the invention that the rotor shaft be assembled from two base parts as well as a number of intermediate pieces which corresponds to the number of additional axial sections. Aside from simple adaptation of the rotor shaft to the corresponding case of need, this has the advantage that a structural height corresponding to the entire shaft length need not be present above the apparatus.

BRIEF DESCRIPTION OF THE DRAWINGS

Four illustrative embodiments of the apparatus of the invention are shown in the drawing, in which:

FIG. 6 is a vertical section through a fourth embodiment, and FIG. 7 is a side view of FIG. 6.

DETAILED DESCRIPTION OF THE PREFERRED EMBODIMENTS

Figure 1:
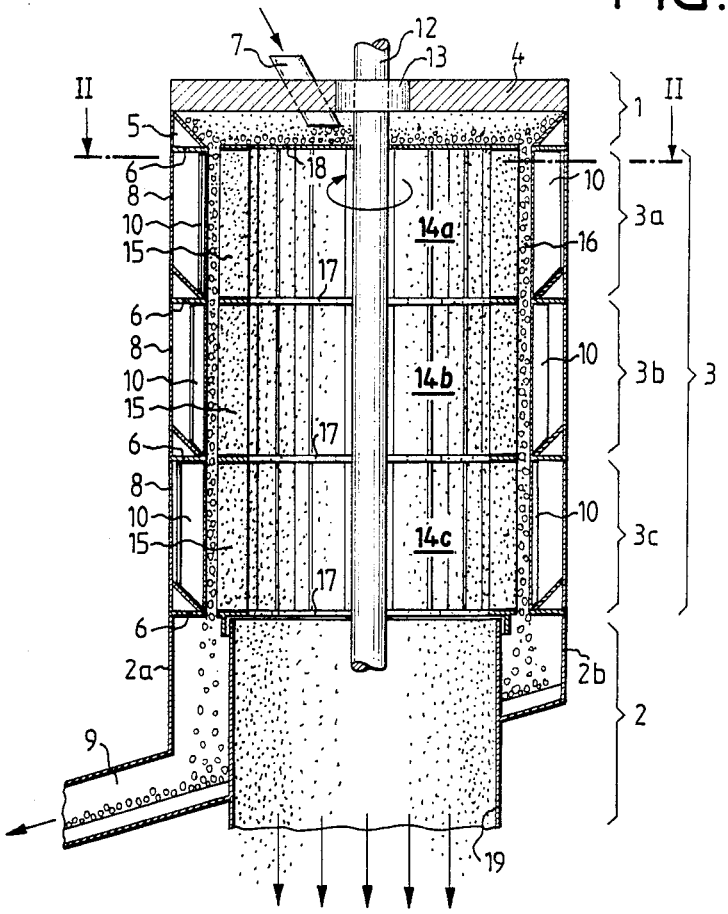
FIG. 1 is a vertical section through a first embodiment.
Figure 2:
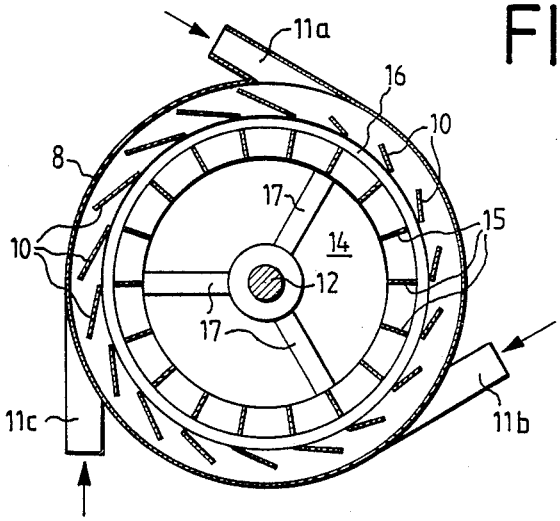
FIG. 2 is a horizontal section along the section line II—II of FIG. 1.

The apparatus for the classifying of powdered bulk materials by air sifting which is shown on basis of a vertical section in FIG. 1 consists of an upper part 1, a lower part 2 and a housing part 3, which, in the embodiment shown in FIGS. 1 and 2, is assembled from three identical sections 3*a*, 3*b* and 3*c*.

The upper part 1 comprises a circular housing cover 4 to which the housing ring 5 is fastened. On its bottom this housing ring 5 bears an annular flange 6. A material inlet pipe 7 for the material to be classified is arranged within the housing cover 4.

To the annular flange 6 of the upper part 1 there is connected, via a corresponding annular flange 6, a housing ring 8 which forms the section 3*a* of the housing part 3. Via additional annular flanges 6, two additional housing rings 8 are connected in the embodiment shown in FIG. 1, they forming the sections 3*b* and 3*c* of the housing part 3, and the lower part 2 being connected to their lower annular flange 6. This lower part 6 also consists of a housing ring 2*a* and an obliquely extending bottom 2*b* adjoining which there is a coarse-material discharge tube 9.

Within each housing ring 8 there is arranged a fixed vane ring of guide vanes 10. Sifting air is fed to said vane ring through a tangentially arranged air inlet connection 11. In the embodiment shown in FIGS. 1 and 2, one such air inlet connection 11 is provided for each housing ring 8. Of course, a plurality of tangentially arranged air inlet connections 11 may also be present for each housing ring 8. As shown in FIG. 2, the air inlet connections 11*a*, 11*b*, 11*c* of the housing rings 8 which are arranged one above the other are shifted with respect to each other in circumferential direction corresponding to the number of housing rings 8 so that the sifting air fed as a whole to the apparatus is distributed uniformly over its circumference. The air inlet connection 11*a* belongs, for instance, to the top housing ring 8, the inlet connection 11*b* to the middle housing ring 8 and the inlet connection 11*c* to the bottom housing ring 8.

In order to distribute the sifting air fed only at one place to the vane ring of each housing ring 98 as uniformly as possible over the circumference of the vane ring, the guide vanes 10 which are arranged vertically above one another are directed at the same acute angle to the tangent at the housing ring 8 but developed with width increasing in the direction of flow of the sifting air, as shown in FIG. 2 in accordance with section II—II. In this way there is obtained a cross section of flow which decreases spirally in the direction of flow for action on the guide vanes 10 and thus a uniform distribution of air over the entire circumference of the vane ring.

At least in the housing cover 4, a rotor shaft 12 is rotatably mounted by means of a bearing 13 on which, in the embodiment shown in FIG. 1, three axial sections 14*a*, 14*b* and 14*c* of a rotor 14 are non-turnably fastened. Each axial section 14*a*, 14*b*, 14*c* comprises an annular ring of rotor vanes 15 which are aligned vertically and radially. Between the rotating drivable rotor vanes 15 and the fixed guide vanes 10 there is formed a sifting space 16 of annular cylindrical shape which can be noted both in longitudinal section according to FIG. 1 and in cross section according to FIG. 2.

While in the two lower axial sections 14*b*, 14*c* the rotor vanes 15 arranged on a ring are connected with the rotor shaft 12 via spokes 17 shown in FIG. 2, the upper axial section 14*a* has such spokes 17 only in the lower part. Its top is formed by a closed cover plate 18. This cover plate 18 serves as charging surface for the material fed through the material feed pipe 7.

Below the rotor 14 of the axial sections 14*a*, 14*b*, 14*c*, which rotor is open as a result of the spokes 17, there is arranged in the lower part 2 a fixed pipe 19 which passes through the bottom 2*b* of the lower part 2. Through this pipe 19 the sifting air which is charged with fine material is discharged downward out of the apparatus described above, as indicated by the arrows in FIG. 1.

The separating of the material fed through the material feed pipe 7 into fine and coarse material is effected as follows:

The material to be classified passes, first of all, onto the cover plate 18 of the rotating rotor 14 which is formed of the axial sections 14*a*, 14*b*, 14*c* and the material is thereby slung outward in radial direction so that it enters from above into the sifting space 16 of annular cylindrical shape. Within this sifting space the material to be classified is subjected to the action of suction which results from the difference between the air velocity of the sifting air fed through the stationary guide vanes 10 and the air which is conveyed outward from the rotor blades 15 as a result of the rotation. Since the air velocity of the sifting air fed via the air inlet connection 11 to the vane ring and guide vanes 18 is greater than the velocity of the air moved by the rotation of the rotor from the rotor vanes 15, there results as a whole, a flow of air from the entire periphery of the vane rings consisting of guide vanes 10 transverse to the sifting space 16 of annular cylindrical shape and through the ring of rotor vanes 15 into the inside of the corresponding axial section 14*a*, 14*b*, 14*c*.

This movement of the sifting air carries along, corresponding to its velocity, a part of the material falling downward within the sifting space 16 into the inside of the axial sections 14*a*, 14*b*, 14*c*. The entrained material forms the portion of fine material, which portion is dependent upon the air velocity set in each case. The material not entrained into the interior of the axial sections 14*a*, 14*b*, 14*c* drops downward as coarse material through the sifting space 16 and passes into the lower part 2, from where it is removed through the coarse material discharge pipe 9, for instance by means of an air conveyor trough.

Since the sifting air which is laden with fine material flows downward in the rotor 14 formed of a plurality of rotor sections 14*a*, 14*b*, 14*c* and then enters into the vertically downward extending stationary pipe 19 arranged below the rotor 14, no additional expenditure of energy results for the transport of the fine material within the apparatus described above.

Figure 3:
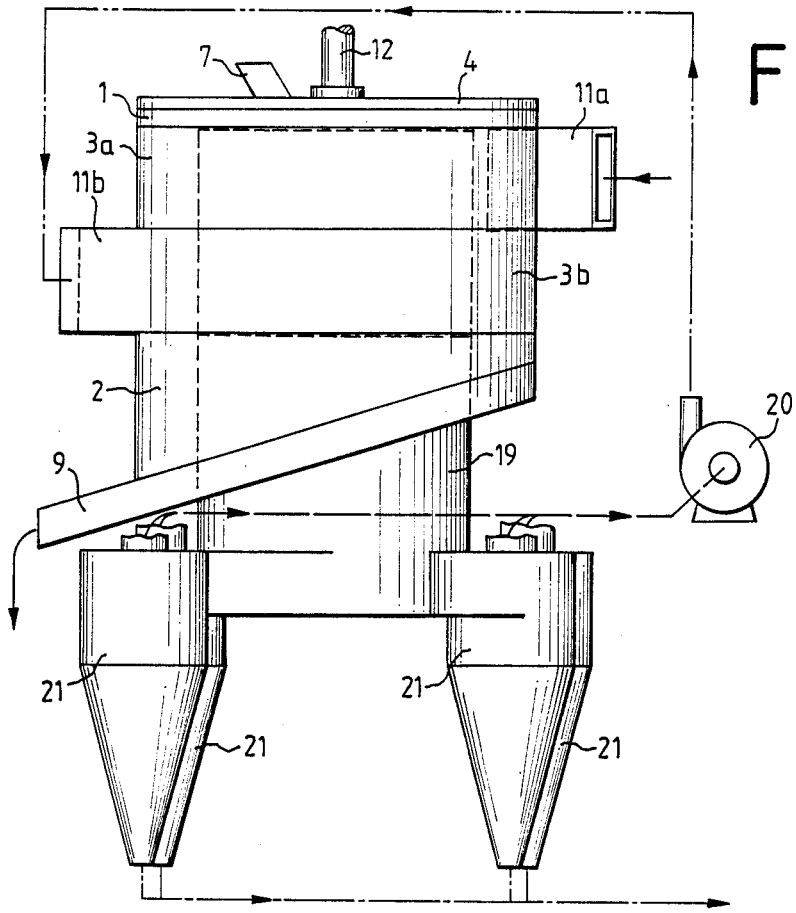
FIG. 3 is a side view of a second embodiment with four subsequent. cyclone separators for the removal of the fine material from the sifting air.
Figure 4:
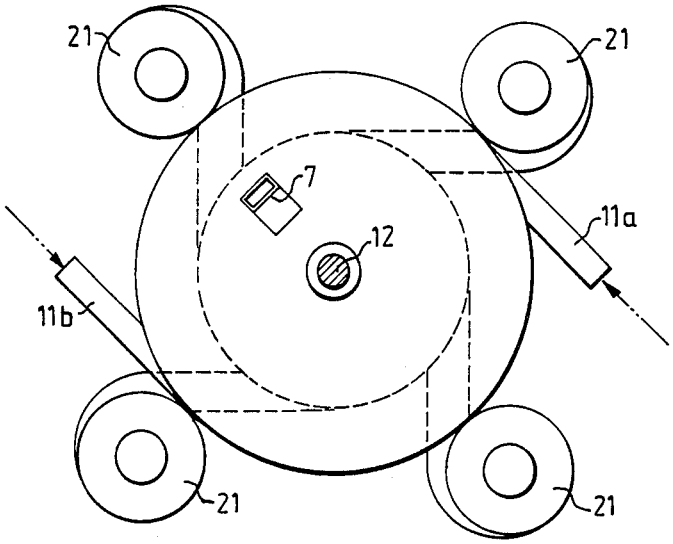
FIG. 4 is a top view of the apparatus of FIG. 3.

The embodiment in accordance with FIGS. 3 and 4 shows that the sifting air fed to the vane rings formed of stationary guide vanes 10 is produced by a fan 20 which is arranged outside the apparatus and, in the embodiment shown, circulates the sifting air in a closed circuit. The fan 20 which is developed as a radial blower forces the sifting air via the air inlet connection 11 into the housing rings 8 only two of which are arranged, one above the other, in the embodiment shown in FIG. 3. The sifting air laden with fine material passes from the stationary pipe 19 in accordance with the embodiment of FIGS. 3 and 4 into a total of four cyclone separators 21 which are connected, distributed uniformly around the circumference in accordance with FIG. 4, to the lower end of the pipe 19. In these cyclone separators 21, the separation of the sifting air from the fine material takes place, the fine material emerging from the lower ends of the cyclone separators 21. The sifting air which has been freed from the fine material is drawn in at the top of the cyclone separators 21 by the fan 20 so that a closed circuit for the sifting air results.

Figure 5:
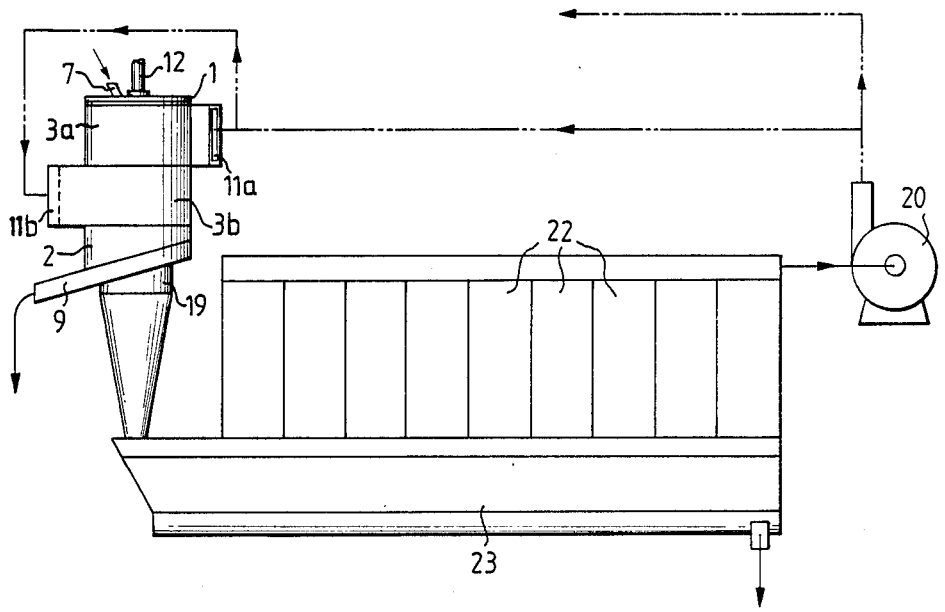
FIG. 5 is a side view of a third embodiment.

In the case of the third embodiment, shown in FIG. 5 there can also be noted the fan 20 which is arranged outside of the actual sifting device and feeds the sifting air again to a sifter which consists of an upper part 1, a lower part 2 and a housing part 3 of two sections 3*a* and 3b. In this embodiment, the separation of the sifting air laden with fine material which emerges out of the bottom of the pipe 19 takes place through a plurality of filters 22 which are connected on the suction side to the fan 20 and are arranged above a fine-material discharge trough 23.

The amount of material to be classified by the corresponding sifter can be determined by selection of the corresponding number of housing rings 8 and axial sections 14a, 14b, 14c since the axial length of the sifting space 16 of annular cylindrical shape and thus its sifting capacity are increased by an increase in the number of housing rings 8 and rotor sections 14a, 14b, 14c. With the same diameter of the sifting device and with the use of identical structural parts, the sifting capacity of the apparatus can thus be adapted in simple manner to what is required. In this connection, regardless of the sifting capacity, the upper part 1 and the lower part 2 as well as the upper housing ring 8 and the upper axial section 14a remain the same. There is merely a change in the number of the again identical lower housing rings 8 and rotor sections 14b, 14c so that sifting devices of different capacity can be set up in building-block fashion with a minimum of different building parts.

In the case of the fourth embodiment, shown in FIGS. 6 and 7, the apparatus for the classifying of powdered bulk materials by air sifting is also assembled in building-block fashion. As shown by the sectional view of FIG. 6, in this embodiment the sifting-space housing consists of an upper part 1, a lower part 2 and a housing part 3 which is assembled of two identical sections 3a and 3b. The upper part 1 again comprises a circular housing cover 4 having a housing ring 5 for connection to the housing part 3. The housing cover 4 has two material inlet pipes 7; the lower part 2 is connected to a coarse material discharge pipe 9.

Each section 3a and 3b of the housing part 3 consists of a housing ring 8 within which a stationary vane ring of guide vanes 10 is arranged. To this extent, the fourth embodiment also agrees with the above-indicated embodiments. To each housing ring 8 there corresponds a section 14a or 14b of the rotor 14, which has an annular ring of rotor blades 15.

Differing from the above embodiments, in the fourth embodiment the rotor shaft 12 is assembled from two base parts 12a and 12b and an intermediate piece 12c. By this division of the rotor shaft 12 into individual sections it is possible to assemble also the rotor shaft 12 in building-block fashion, in which connection in each case a number of intermediate pieces 12c corresponding to the number of the axial sections of the rotor 14 exceeding 1 is used. Accordingly, it is not necessary to produce and keep in stock different rotor shafts 12 if sifting devices of different capacity are to be assembled. Furthermore, it is not necessary to provide such a high space above the sifting device that the rotor shaft 12 can be removed as a whole from the top. The possibility of breaking the rotor shaft 12 down into individual sections 12a, 12b and 12c thus reduces also the amount of space required above the sifting apparatus.

Another difference between the fourth embodiment and the embodiments described above is that, instead of a common fan 20, use is made of individual fans 24a, 24b, which, as shown in FIG. 7, are each placed on a cyclone 21a, 21b. Each of these cyclones 21a, 21b is connected to a housing section 3a and 3b respectively of the housing part 3, as shown in FIG. 7. In this way, the amount of sifting air and the number of cyclones 21a, 21b changes with the number of sections 3a, 3b of the housing part 3 so that, to this extent also, a building-block-like assembling of the entire apparatus is obtained. As shown in FIG. 7, each fan 24a and 24b is driven by its own motor 25a, 25b. The advantage of this embodiment is not only the possibility of a building-block-like assembly but also short, small air lines result and the pressure losses are thus decreased. Furthermore, the use of fans 24a, 24b associated in each case with an axial section of the sifting apparatus creates the possibility of providing different air outputs per sifting plane should this be desirable and necessary for the sifting output.

In conclusion, it should be pointed out that, with the apparatus described above, not only is it possible to obtain a sifting of the powdered bulk material but also a cooling or drying thereof in the manner that the sifting air is either previously cooled, or at least partially replaced by cold fresh air, or else heated, for instance by heating gas generators or by the use of hot exhaust air, such as available, for instance, generally in the form of furnace off-gases or cooler off-air.

I claim:

1. An apparatus operative with fine and course material for the classifying of powdered bulk materials, particularly ground clinker, limestone or cement raw material, by air sifting, the apparatus comprising a material inlet, a cylindrical rotor having vertical rotor blades and a cover plate, a stationary vane ring spaced apart from and surrounding the rotor, a fan located outside of the rotor, a pipe for discharging fine material from the rotor, a separating device located down stream of the discharge pipe, a coarse material discharge for discharging coarse material from the rotor, said rotor and said vane ring defining a sifting space; and wherein the material to be classified is fed via the material inlet to the cover plate of the cylindrical rotor and is charged into said sifting space, said sifting space having the shape of a cylindrical ring, which space extends between the rotor and the stationary vane ring, a bottom portion of said housing including a receiving ring disposed beneath and mating with said sifting space for receiving course material, said receiving ring encircling said fine material discharge pipe, said course material discharge extending from said receiving ring;

the sifting air is drawn-in through the sifting space approximately tangentially to a cylindrical surface thereof by the fan so that fine material contained in the material charged is conveyed, as a result of suction action which results from a difference between hydrostatic pressure of the fan and a radially outward directed hydrostatic pressure of the rotor;

the sifting air is drawn into the inside of the rotor, discharged through the pipe vertically downward and fed subsequently to the separating device for the separation of fine material and sifting air, while coarse material descends in the sifting space and is discharged via the housing ring and the coarse material discharge;

the apparatus further comprises a cylindrical housing which encloses the rotor and receives the vane ring; and the rotor and the cylindrical housing an the vane ring is assembled from a plurality of axial sections disposed one upon the other in axial alignment, the sifting space communicating between individual ones of said sections, there being at least one tangential air inlet connection operatively coupled to said housing at each said section; and wherein guide vanes of the vane rings of each section are arranged vertically, are each directed at the same acute angle to a respective tangent to a cylindrical surface of the housing, and each successive vane is constructed with a width which increases in the direction of flow, said cover plate being mounted on an uppermost one of said sections, and the sifting air is drawn in via the air inlet in each said section.

2. An apparatus according to claim 1, wherein the air inlet connections of respective ones of the sections are arranged one above the other and are staggered with respect to each other in circumferential direction.

3. An apparatus according to claim 1, wherein at least one cyclone is connected to each section, a separate fan being placed on each cyclone.

4. An apparatus according to claim 1, wherein the rotor includes a shaft comprising a plurality of intermediate pieces corresponding in number to the number of said sections.

* * * * *